US012465099B1

(12) United States Patent
Leach

(10) Patent No.: US 12,465,099 B1
(45) Date of Patent: Nov. 11, 2025

(54) INFINITY SCARF WITH SECURE POCKET

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 478 days.

(21) Appl. No.: 17/212,117

(22) Filed: Mar. 25, 2021

Related U.S. Application Data

(60) Provisional application No. 63/001,698, filed on Mar. 30, 2020.

(51) Int. Cl.
*A41D 23/00* (2006.01)
*A41D 27/20* (2006.01)

(52) U.S. Cl.
CPC ..... *A41D 23/00* (2013.01); *A41D 27/201* (2013.01)

(58) Field of Classification Search
CPC ..... A41D 23/00; A41D 2023/004; A41D 2400/422; A41D 20/00; A41D 2023/002; A41D 15/00; A41D 2400/482; A41D 7/008; A41D 1/22; A41D 2300/22; A41D 27/08; A42B 1/041
USPC ..... 2/207, 181, 91
See application file for complete search history.

(56) References Cited

U.S. PATENT DOCUMENTS 891,166 A 6/1908 Harrison
1,936,045 A 11/1933 Bachrach
2,420,344 A * 5/1947 Cook ..... A47K 10/02 D2/714
2,806,222 A * 9/1957 Carpenter ..... A41D 1/22 2/207
3,320,620 A * 5/1967 Weidler ..... A63B 57/20 224/919
4,109,321 A 8/1978 Shapiro
4,462,117 A * 7/1984 Brunelle ..... A41D 23/00 2/202
4,498,200 A 2/1985 Livingstone
4,631,754 A 12/1986 Ryan
(Continued)

FOREIGN PATENT DOCUMENTS

GB 2384163 A * 7/2003 ..... A41D 1/22
JP 2006169674 A 6/2006
(Continued)

OTHER PUBLICATIONS

English translation of KR20080001373U (Year: 2008).*
(Continued)

*Primary Examiner* — Khoa D Huynh
*Assistant Examiner* — Grady Alexander Nunnery
(74) *Attorney, Agent, or Firm* — Mary M. Lee

(57) ABSTRACT

A neck scarf or shawl formed of a cylindrical of fabric. The transverse width and the circumference of the tubular body are sized to permit the scarf to be worn by an adult person and to cover the upper arms and upper body of the person in a fully deployed position. The cylinder of fabric has upper and lower circular edges with first and second elastic sections. A closeable pouch is secured on the inside of the fabric cylinder between the elastic edge sections. An open pocket may be provided on the surface of the pouch. The elastic sections allow the pouch and its contents to be secured by twisting the panel so that the pouch it is secured inside a double-wrapped layer of fabric. The pouch may be lined with RFID blocking material to prevent surreptitious reading of credit cards or other magnetic data media inside the pouch.

10 Claims, 9 Drawing Sheets

(56) References Cited

U.S. PATENT DOCUMENTS

| | | | | |
|---|---|---|---|---|
| 4,712,251 | A | 12/1987 | Cobble | |
| 4,834,459 | A | 5/1989 | Leach | |
| 4,861,109 | A | 8/1989 | Leach | |
| D309,018 | S | 7/1990 | Leach | |
| 4,987,612 | A | 1/1991 | Middleton | |
| 5,103,514 | A | 4/1992 | Leach | |
| 5,144,696 | A * | 9/1992 | Kahl | A41D 23/00 2/311 |
| 5,325,818 | A | 7/1994 | Leach | |
| 5,592,692 | A | 1/1997 | Larson | |
| 5,960,471 | A | 10/1999 | Burton | |
| 6,016,573 | A | 1/2000 | Olson | |
| 6,301,713 | B1 | 10/2001 | Aceves et al. | |
| 6,343,727 | B1 | 2/2002 | Leach | |
| 6,427,251 | B1 | 8/2002 | Leach | |
| 6,499,164 | B1 | 12/2002 | Leach | |
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 | 7/2004 | Leach | |
| 6,986,163 | B2 | 1/2006 | Dugan | |
| 7,010,821 | B1 | 3/2006 | Leach | |
| 7,114,206 | B2 | 10/2006 | Leach | |
| 7,207,070 | B1 | 4/2007 | Swarez-Ballesteros | |
| 7,353,552 | B2 | 4/2008 | Leach | |
| D571,596 | S | 6/2008 | Alvisture et al. | |
| 7,467,423 | B1 | 12/2008 | Tawfik | |
| 7,490,362 | B2 | 2/2009 | Owen | |
| 7,500,278 | B2 | 3/2009 | Leach | |
| 7,513,001 | B1 | 4/2009 | Leach | |
| D591,483 | S | 5/2009 | Petti et al. | |
| 7,555,790 | B2 | 7/2009 | Ostrander | |
| 7,562,406 | B1 | 7/2009 | Leach | |
| 7,640,600 | B2 | 1/2010 | Reder | |
| 7,676,871 | B1 | 3/2010 | Leach | |
| 7,708,342 | B2 | 5/2010 | Leach | |
| 7,793,371 | B1 | 9/2010 | Leach | |
| 7,878,587 | B1 | 2/2011 | Leach | |
| 7,926,135 | B1 | 4/2011 | Leach | |
| 8,020,217 | B2 | 9/2011 | Moore et al. | |
| 8,136,186 | B1 | 3/2012 | Leach | |
| 8,146,760 | B1 | 4/2012 | Leach | |
| 8,151,372 | B2 | 4/2012 | Densmore et al. | |
| 8,419,128 | B1 | 4/2013 | Leach | |
| 8,448,275 | B1 | 5/2013 | Leach | |
| 8,468,627 | B2 | 6/2013 | Leach | |
| 8,479,334 | B1 | 7/2013 | Leach | |
| 8,555,429 | B2 | 10/2013 | Leach | |
| 8,661,587 | B1 | 3/2014 | Leach | |
| 8,661,588 | B1 | 3/2014 | Leach | |
| 8,671,480 | B1 | 3/2014 | Leach | |
| 8,914,927 | B1 | 12/2014 | Leach | |
| 9,003,565 | B1 | 4/2015 | Leach | |
| 9,021,635 | B1 | 5/2015 | Leach | |
| 9,032,572 | B1 | 5/2015 | Leach | |
| 9,101,169 | B1 | 8/2015 | Leach | |
| 9,113,718 | B1 | 8/2015 | Leach | |
| 9,635,956 | B1 | 5/2017 | Leach | |
| 9,693,638 | B1 | 7/2017 | Leach | |
| 10,729,257 | B1 | 8/2020 | Leach | |
| 10,736,444 | B1 | 8/2020 | Leach | |
| 10,806,278 | B1 | 10/2020 | Leach | |
| 11,039,399 | B2 | 6/2021 | Leach | |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0124845 | A1 | 6/2007 | McCoy | |
| 2007/0151031 | A1 | 7/2007 | Leach | |
| 2007/0277321 | A1 | 12/2007 | Leach | |
| 2008/0222768 | A1 | 9/2008 | Haarala et al. | |
| 2009/0222969 | A1 * | 9/2009 | Townsend | A41D 23/00 2/202 |
| 2009/0260127 | A1 | 10/2009 | Prezgar | |
| 2010/0235963 | A1 | 9/2010 | Haydon | |
| 2010/0237121 | A1 | 9/2010 | Stein | |
| 2011/0138519 | A1 | 6/2011 | Serota | |
| 2011/0209266 | A1 * | 9/2011 | Perry | A41D 23/00 2/207 |
| 2011/0296581 | A1 | 12/2011 | Armstrong | |
| 2012/0030858 | A1 * | 2/2012 | Duffin | A42B 1/04 2/183 |
| 2012/0284893 | A1 | 11/2012 | Sohn | |
| 2013/0152271 | A1 | 6/2013 | Clark | |
| 2013/0334270 | A1 | 12/2013 | Smith | |
| 2014/0034520 | A1 * | 2/2014 | Scicluna | H01Q 1/2225 150/132 |
| 2017/0215499 | A1 * | 8/2017 | Sobers | A41D 23/00 |

FOREIGN PATENT DOCUMENTS

| | | | | |
|---|---|---|---|---|
| JP | 2006214025 | A | 8/2006 | |
| KR | 20080001373 | U * | 5/2008 | A47D 13/02 |

OTHER PUBLICATIONS

Uncaged LLL, "Sholdit" [online] webpage retrieved from http://www.sholdit.com, Uncaged LLC, Omaha, Nebraska, USA. The first publication date of this reference is unknown. This document was published prior to the effective filing date, namely, Oct. 2, 2014, and prior to any foreign priority date of the present application. [retrieved on Feb. 13, 2013]. Exhibit H (2 pages).

Uncaged LLL, "Sholdit" [online] webpage retrieved from http://www.sholdit.com, Uncaged LLC, Omaha, Nebraska, USA. The first publication date of this reference is unknown. This document was published prior to the effective filing date, namely, Oct. 2, 2014, and prior to any foreign priority date of the present application. [retrieved on Dec. 2, 2012]. Exhibit I (2 pages).

Sondra Hinnenkamp D/B/A Stella Bellas Designs, "Hold Me Close Chevron Nursing Scarf . . . " [online] webpage retrieved from http://www.etsy.com, Sondra Hinnenkamp d/b/a Stella Bella Designs, Buffalo, MN, USA. The first publication date of this reference is unknown. This document was published prior to the effective filing date, namely, Oct. 2, 2014, and prior to any foreign priority date of the present application. [retrieved on Jun. 18, 2013]. Exhibit J (2 pages).

Leachco, Inc., Cuddle-U Mother Cover product, which is shown and described in attached Exhibit A to this Statement, was in public use and/or on sale at least as early as about Sep. 13, 2011.

Leachco, Inc., Mother Cover Duo product, which is shown and described in attached Exhibit B to this Statement, was in public use and/or on sale at least as early as about Nov. 26, 1997.

Leachco, Inc., Covered 'N Cool product, which is shown and described in attached Exhibit C to this Statement, was in public use and/or on sale at least as early as about Dec. 1, 2000.

Leachco, Inc., "Leachco Duo Nursing Infinity Scarf," [online] webpage retrieved from https://www.walmart.com/ip/Leachco-Duo-Nursing-Infinity-Scarf/40870599, Walmart Apollo, LLC, Bentonville, AR, USA. The first pub'n date is unknown. This was pub'd prior to the eff.filing date Mar. 30, 2020 and prior to any foreign priority date of the present application. [retrieved on Oct. 26, 2022]. Exhibit D (18 pages) The product shown in Ex D was in public use and/or on sale at least as early as about 12/00/2014.

* cited by examiner

INFINITY SCARF WITH SECURE POCKET

FIELD OF THE INVENTION

The present invention relates to ladies clothing and, more particularly but without limitation, to neck scarves.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate a preferred embodiment of the invention and are not to be construed as limiting the scope of the invention.

DETAILED DESCRIPTION OF THE PREFERRED EMBODIMENT(S)

Travelers are well aware of the need to have certain items, such as passports and cellphones, securely stowed but still easily accessed when needed. From shoulder bags to "fanny packs," numerous products are available for this purpose. The present invention provides a style neck scarf for carrying personal items. The scarf, which preferably is in the form of an infinity scarf, is an elongate rectangular panel of fabric with the ends joined to form a fabric cylinder. This scarf provides a way to secure personal items that is safe, comfortable, multi-functional, gender-neutral, and fashion forward.

Figure 1:
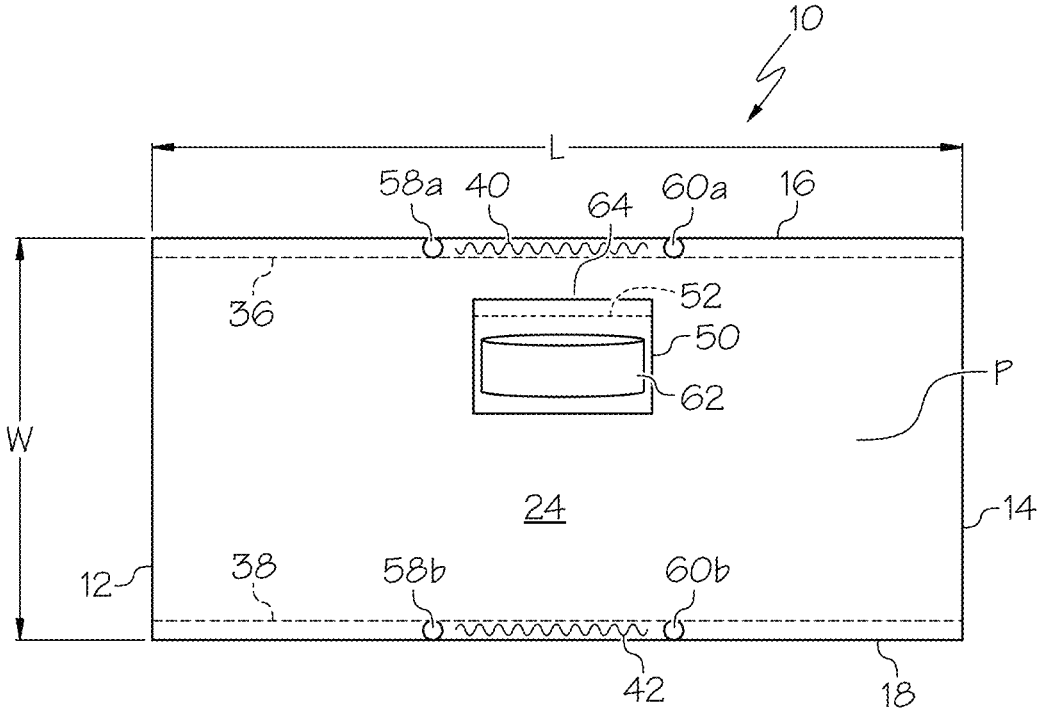
FIG. 1 is a diagrammatic illustration of a rectangular panel of fabric that can be formed into a cylinder in accordance with a preferred embodiment of the present invention.
Figure 2:
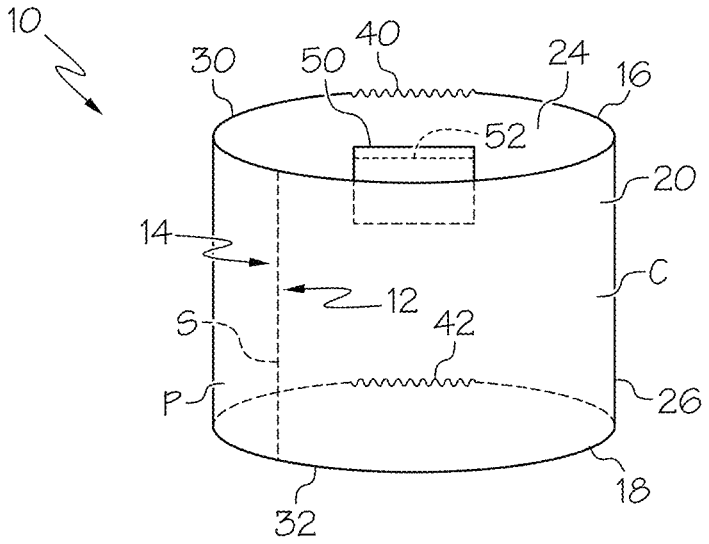
FIG. 2 is a diagrammatic illustration of a neck scarf formed from the rectangular panel of fabric shown in Figure A.

Turning now to the drawings in general and to FIGS. 1 and 2 in particular, there is shown therein a neck scarf, designated generally by the reference number 10. The scarf 10 comprises a rectangular panel "P" of fabric illustrated in Figure A. The panel P (FIG. 1) has first and second ends 12 and 14 and the upper and lower edges 16 and 18. While the dimensions of the panel P may vary, in some embodiments the length L of the panel may be about twice the transverse dimension or width "W" of the panel. (See FIG. 1.) By way of example only, the length L may be about 45-50 inches, and the width W may be about 24-28 inches.

As seen in FIG. 2, when the end edges 12 and 14 are joined at the seam S, the panel P forms a fabric cylinder C having a sidewall 20 with an inner surface 24 and an outer surface 26. The upper edge 16 forms an open upper end 30, and the lower edge 18 forms an open lower end 32. In the preferred embodiment, the cylinder C has the shape of a right circular cylinder, that is, a cylinder that has a closed circular surface having two parallel bases on both the ends and whose elements are perpendicular to its base.

The construction of the scarf 10 may vary. The finished scarf 10 may be a single layer of fabric or a double layer. Virtually any flexible fabric or other material, textile or non-textile, woven or non-woven, may be used to make the scarf 10. In some embodiments, the scarf 10 is made of a lightweight, elastic jersey knit.

The present embodiment of the scarf 10 is a single layer, wherein each of the upper and lower edges 12 and 14 are finished with a hem 36 and 38, respectively (Fig. A). A first elastic section 40 may be provided on the upper edge 16, and a second elastic section 42 may be provided on the lower edge 18. This can be accomplished by any suitable method. For example, a strip of elastic (not shown) may be stitched onto the inner surface 24 of the fabric panel P near the edges 16 and 18 prior to hemming.

In the example shown, the elastic sections 40 and 42 are roughly centered along the length L of the edges 16 and 18, respectively, and are about 6 inches long in the resting or non-extended state. As illustrated in FIGS. 1 and 2, each of the elastic sections 40 and 42 extend only partially around the circumference of the upper and lower edges, respectively. Ideally, the elastic sections 40 and 42 are of about equal length and generally spaced a distance apart and directly across from each other. However, the length and relative positions of the elastic sections 40 and 42 may vary.

Figure 5:
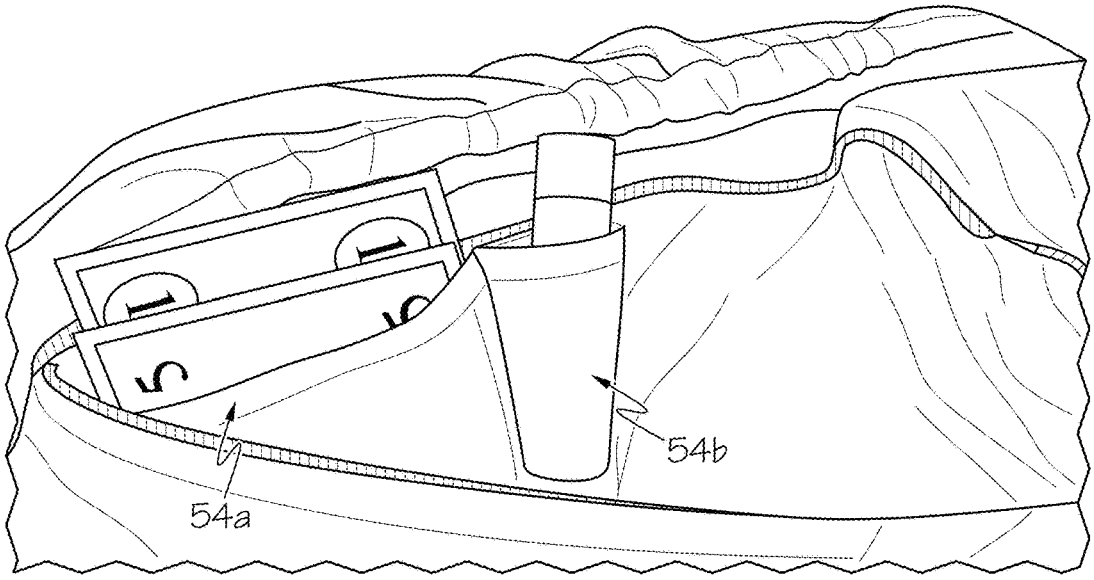
FIG. 5 is an enlarged view of the open pouch showing illustrative dividers sized to fit different sized articles.

With continuing reference to FIGS. 1 and 2, a closable pouch 50 may be provided on the inside surface 24. While the position of the pouch 50 on the panel P may vary, it is advantageous for a reason that will become apparent to position the pouch generally between the elastic edge sections 40 and 42. In the illustrative embodiment, the closure is a zipper 52. Of course, the closure means, when included, may vary. For example, buttons, snaps, ties, hooks, or hook-and-loop fasteners could be used instead. One or more variably sized compartments 54*a* and 54*b* (FIG. 5) may be formed on the inside of the pouch 50 for holding articles, such as credit cards, cell phones, pens/pencils, and so forth.

Figure 3:
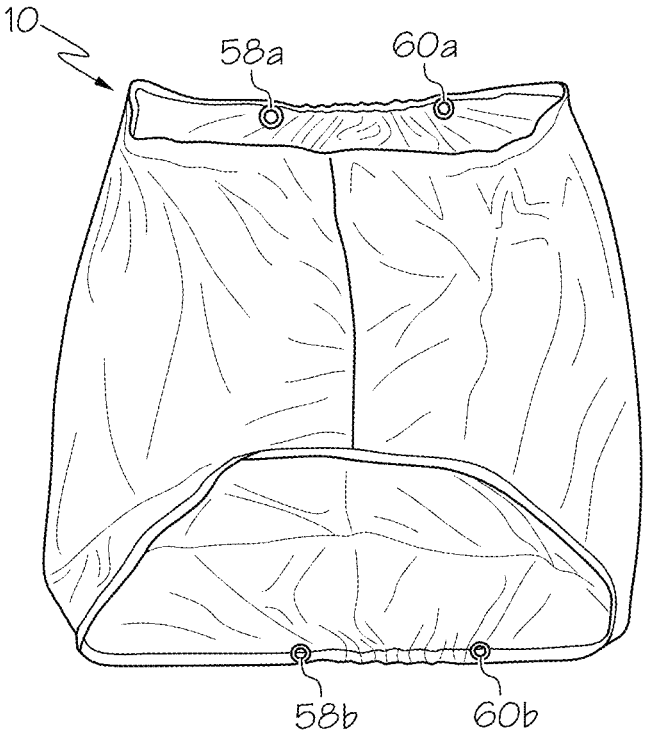
FIG. 3 is a front view of a neck scarf made in accordance with a preferred embodiment of the present invention.
Figure 4:
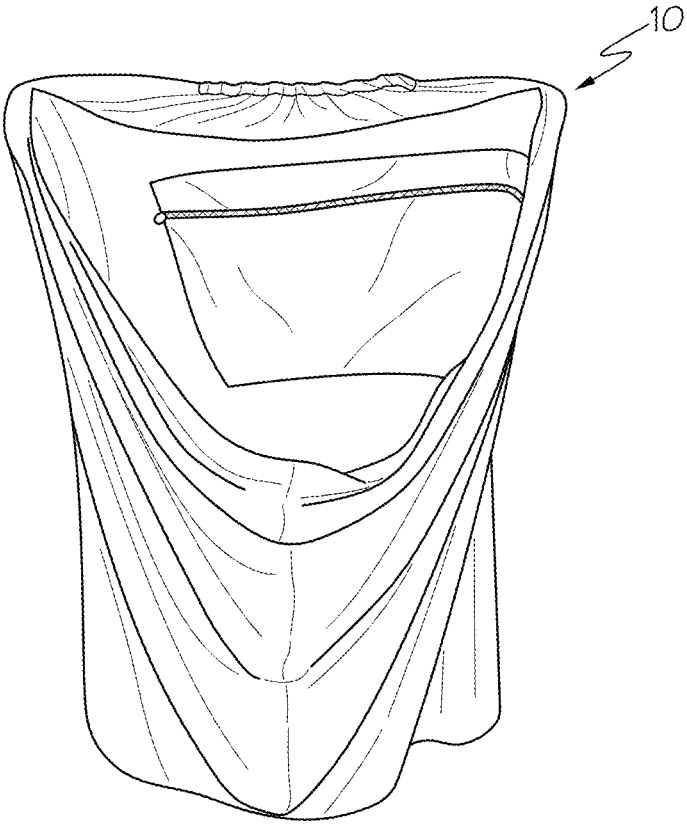
FIG. 4 is a front perspective view of the scarf shown in FIG. 3 with the forward part of the cylinder allowed to hang down exposing the inner surface of fabric panel with the zippered pouch.

As seen in FIGS. 1 and 3, the scarf 10 may be provided with one or more snaps or other connectors, such as the first and second pairs of snaps 58*a* and 58*b* and 60*a* and 6*b*. Preferably, the snaps 58*a* and 58*b* and 60*a* and 6*b* are positioned on the inside edges 16 and 18 on each end of the each of the elastic sections 40 and 42. Once items are place in the pouch 50 and or pocket 62, and the zipper 52 (or other closure device, if any) is closed, the elastic sections 40 and 42 can be brought together in close proximity and then the snaps 58*a* and 58*b* and 60*a* and 6*b* engaged. Specifically, the snaps 58*a* 58*b* are connected to each other, and the snaps 60*a* and 60*b* connected to each other. This lessens the likelihood that scarf 10 will fall out of the desired position enclosing the pouch 50 and pocket 62, as described hereafter.

Figure 6:
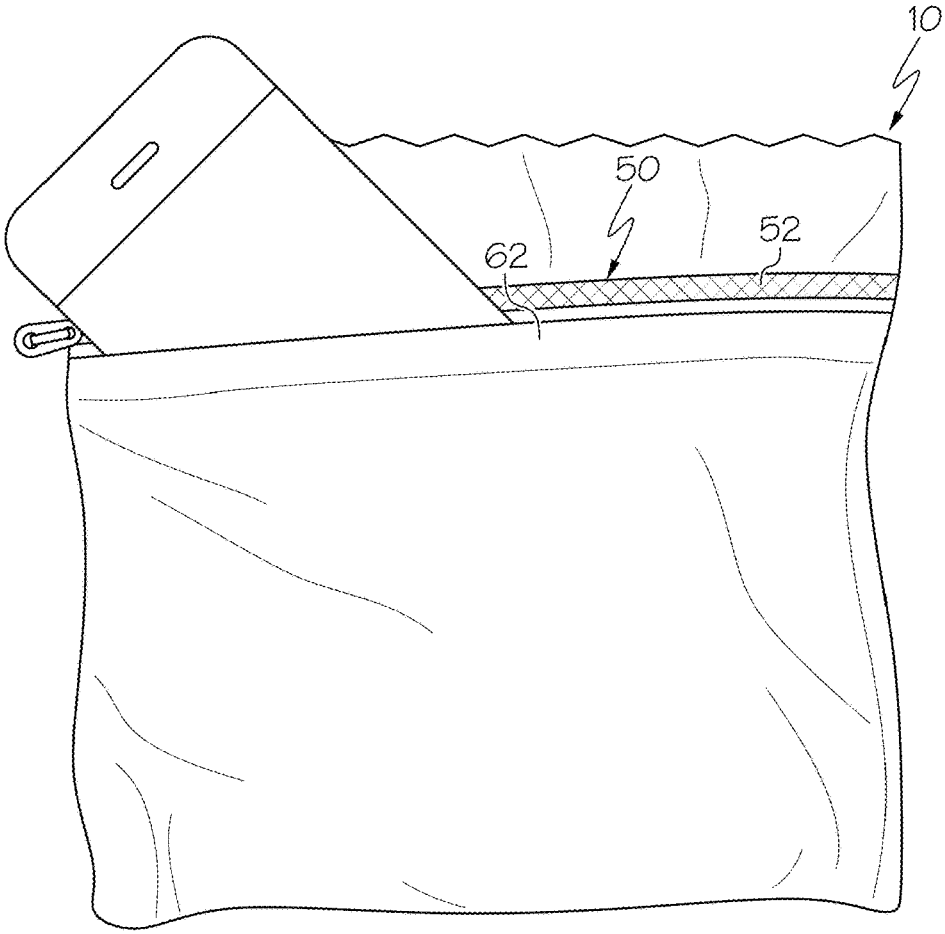
FIG. 6 shows a cell phone partially inserted into the open pocket on the outside of the pouch.

An open pocket 62 (FIG. 1) may be included on the outside of the pouch 50. This allows the user to quickly access articles in the pocket 62 without having to open the zipper 54 to access the pouch 50. For example, as seen in FIG. 6, depending on the situation, a user may prefer to stow her cell phone 58 in the open pocket 62, while credit cards and a passport may be more securely enclosed in the zippered pouch 50.

Although not depicted in the drawings, the pouch 50 or the pocket 62, or both, may be lined or covered with or otherwise protected by an RFID blocking material. As the composition and use of these materials is generally known, they are not described in detail. The use of these protective materials will protect the articles, such as credit cards, inside the pouch or pocket or both from being scanned, accessed, or otherwise acted on surreptitiously.

Figure 7B:
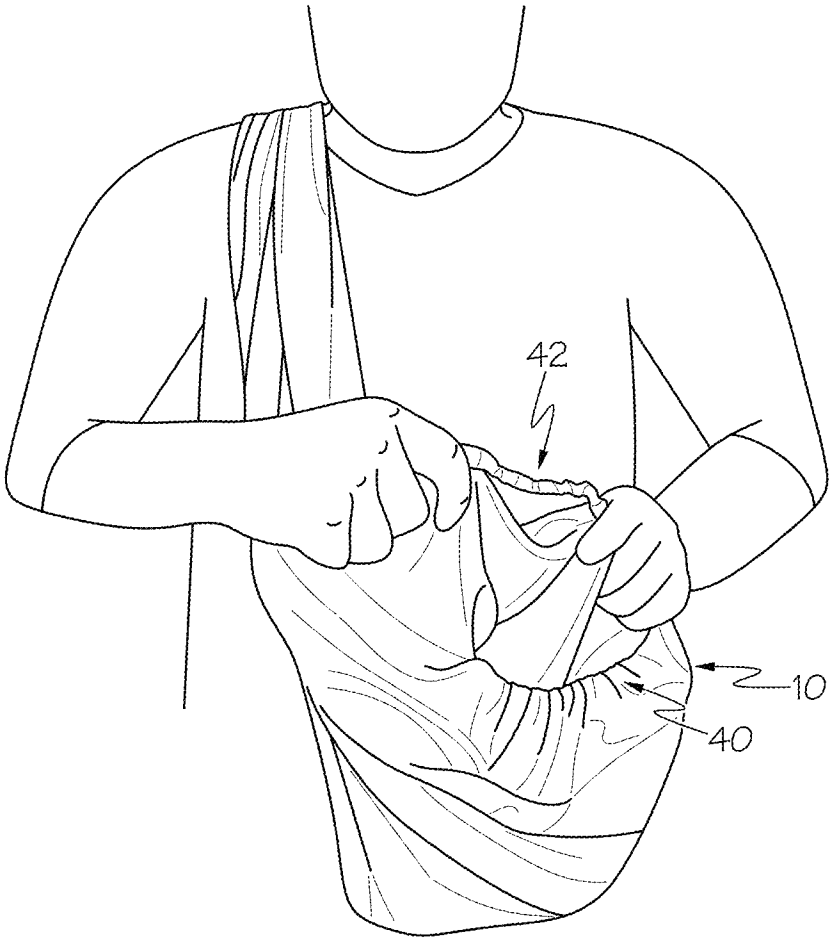
FIGS. 7A-7E illustrate sequentially the steps for enclosing the pouch inside the scarf.
Figure 7A:
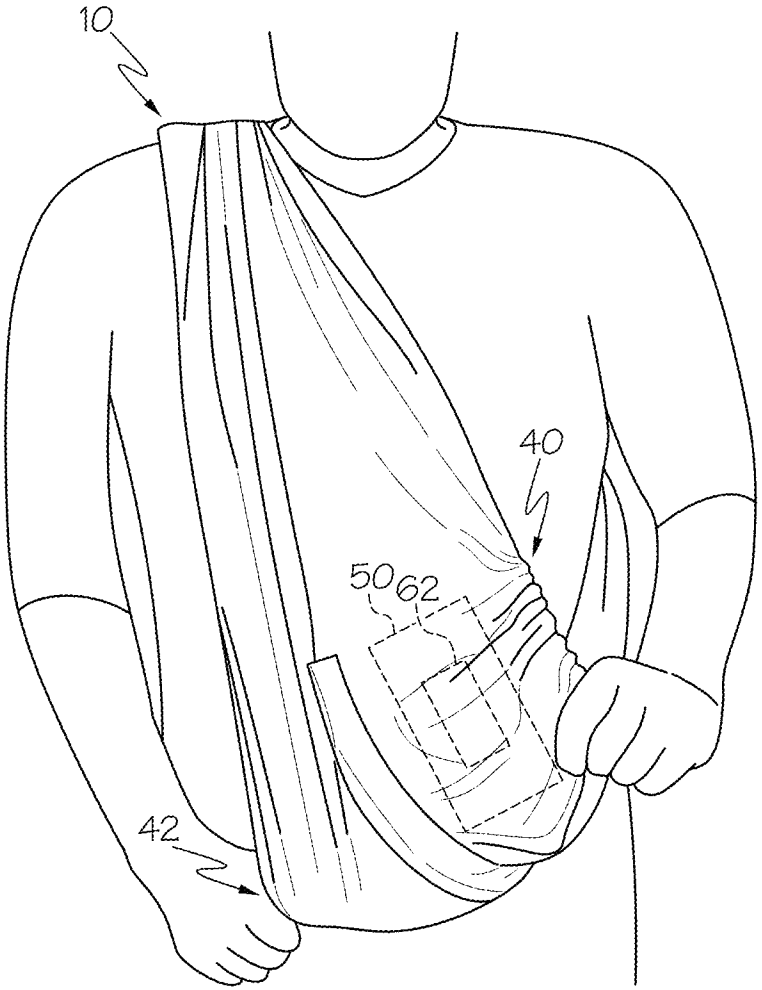
Figure 7D:
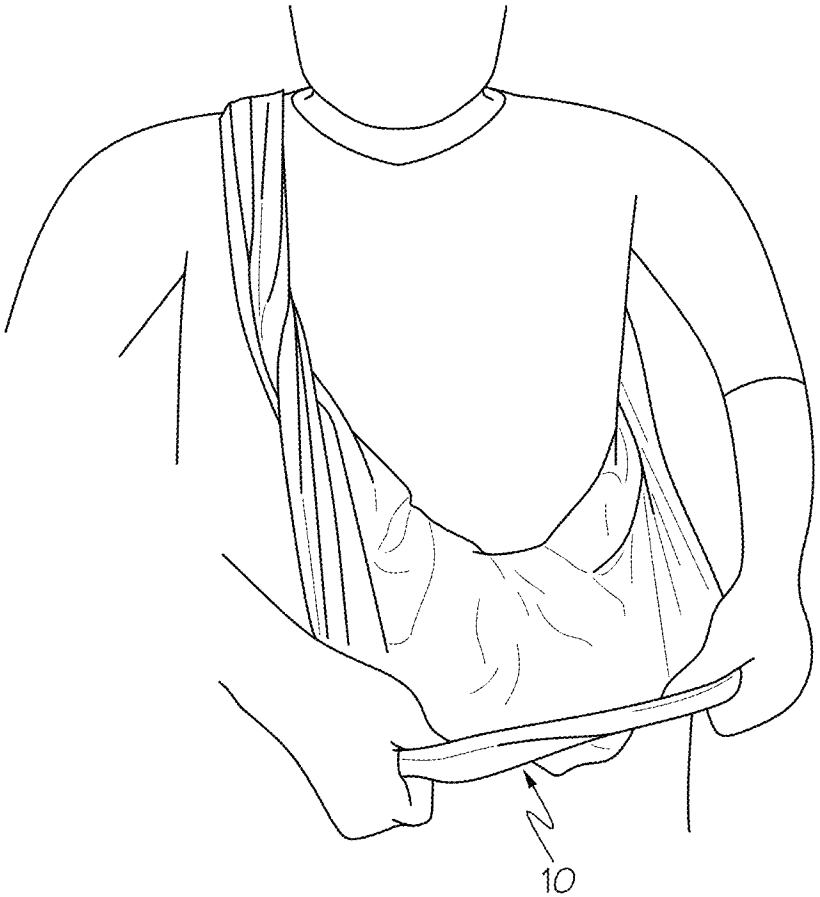
Figure 7C:
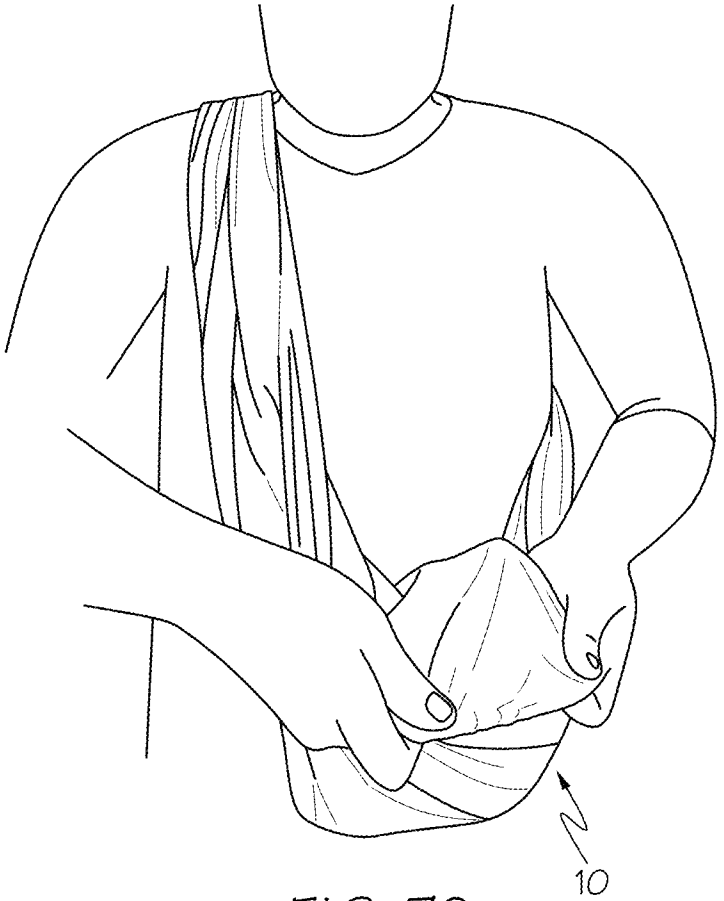
Figure 7E:
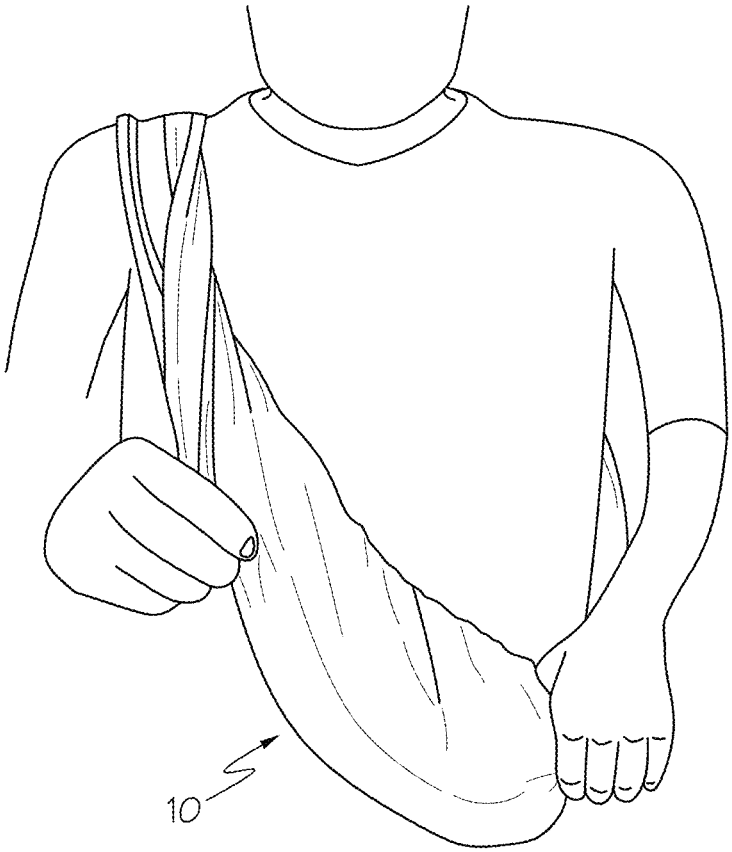

Turning now to FIGS. 7A-7E, one use of the scarf will be explained. In the exemplary configuration shown in FIG. 7A, the scarf 10 is worn over one shoulder and under the opposite arm. In this configuration, the pouch 50 hangs comfortably against the wearer's waist or midriff area. With items (not shown) secured inside the pouch 50 and/or pocket 60, the lower elastic edge section 42 is pulled up and over the upper elastic section 40 (FIG. 7B). Then, as illustrated sequentially in FIGS. 7C-7E, pulled down, over, and back up under around the pouch 50. Now it will be appreciated that the elastic sections 40 and 42 pull or hug the enclosed pouch 50 snuggly. Thus, the contents of the pouch 50 are held close to the body and doubly wrapped in the fabric of the scarf 10. This makes the contents of the pouch 50 physically inaccessibly even to an expert pickpocket. Additionally, with the RFID blocking material, the contents are inaccessible electronically.

Notably, although the scarf 10 is shown in the drawings worn over the user's clothing, alternately it could be worn underneath clothing. Still further, when not in use, the scarf 10 can be folded or rolled into a compact stowage position that will fit easily into a coat pocket or handbag or other carrying case. Additionally, the rolled up scarf 10 can also serve as a neck pillow.

Figure 8B:
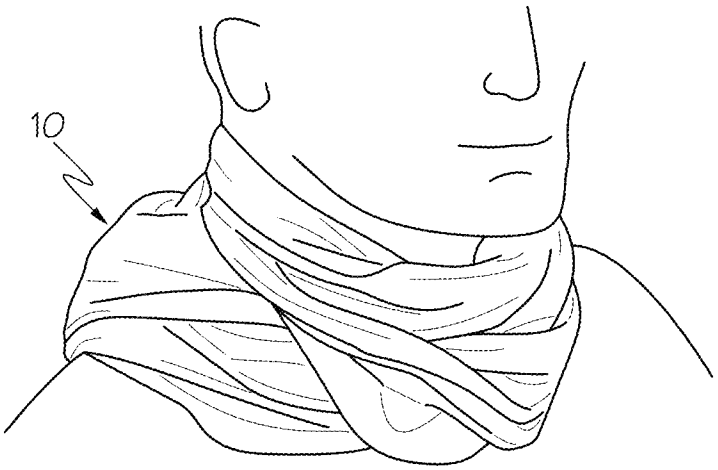
FIGS. 8A-8F illustrate various ways to configure the scarf for different purposes.
Figure 8A:
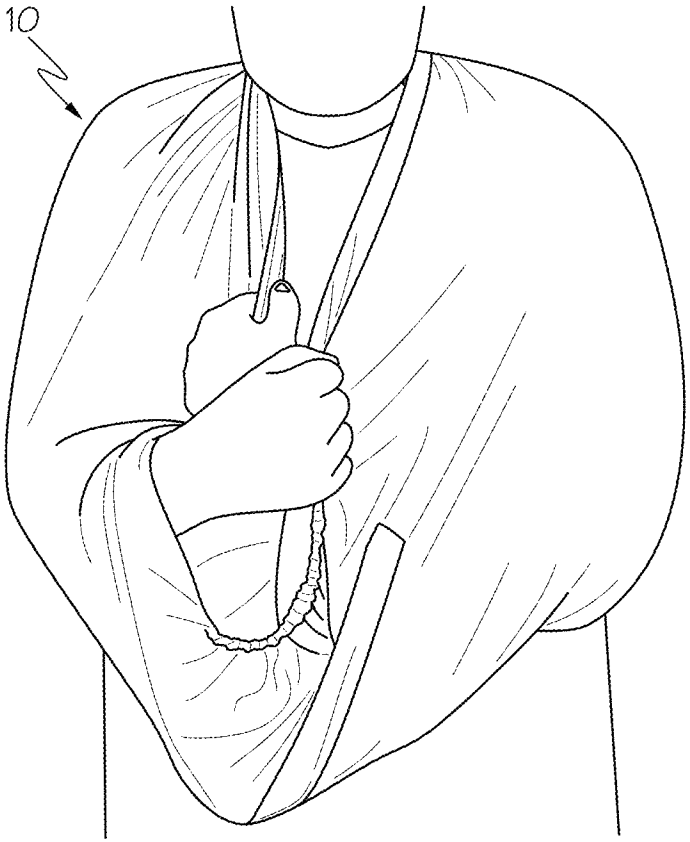
Figure 8D:
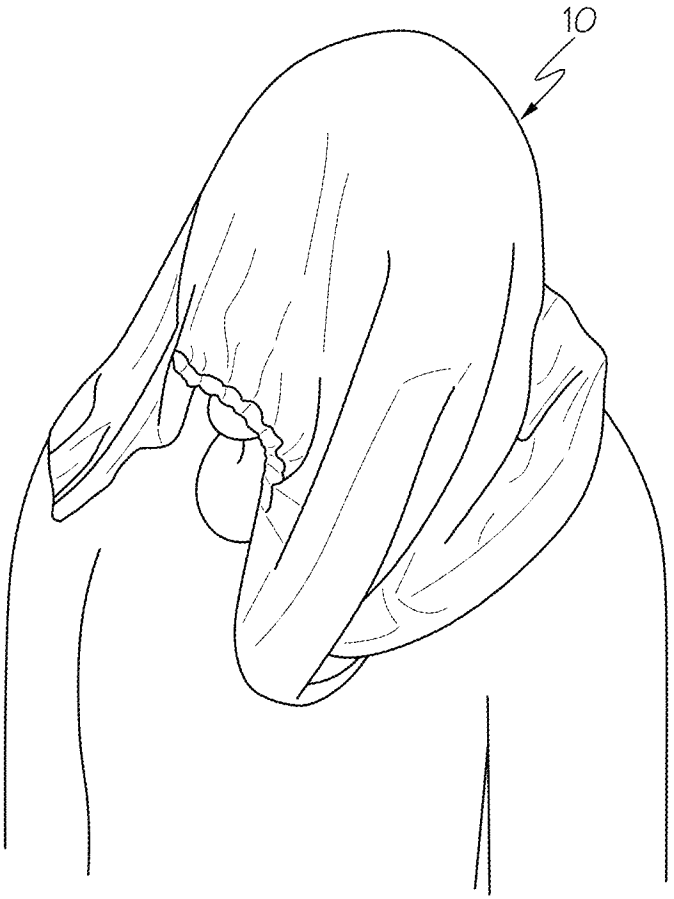
Figure 8C:
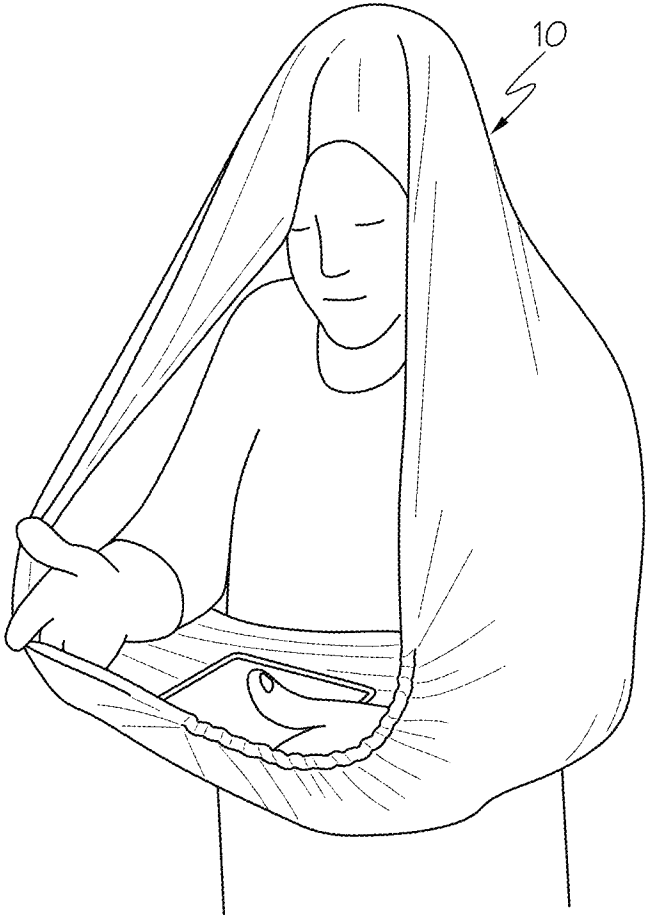

Several other uses of the inventive scarf 10 are illustrated in FIG. 8A-8F. Worn around the shoulders, as seen in FIG. 8A, the scarf serves as shawl or warming wrap. When not in use to hold valuables, the scarf 10 can be worn in a fashionable double-wrap style, as depicted in FIG. 8B. Draped over the head and around the arms, the scarf serves as a privacy scarf when using a phone or tablet device or reading printed matter, as illustrated in FIG. 8C. This is particularly advantageous when using electronic devices, as the scarf reduces the light affecting the screen. Even with printed matter, the scarf prevents other "prying eyes" from observing the written content.

Figure 8F:
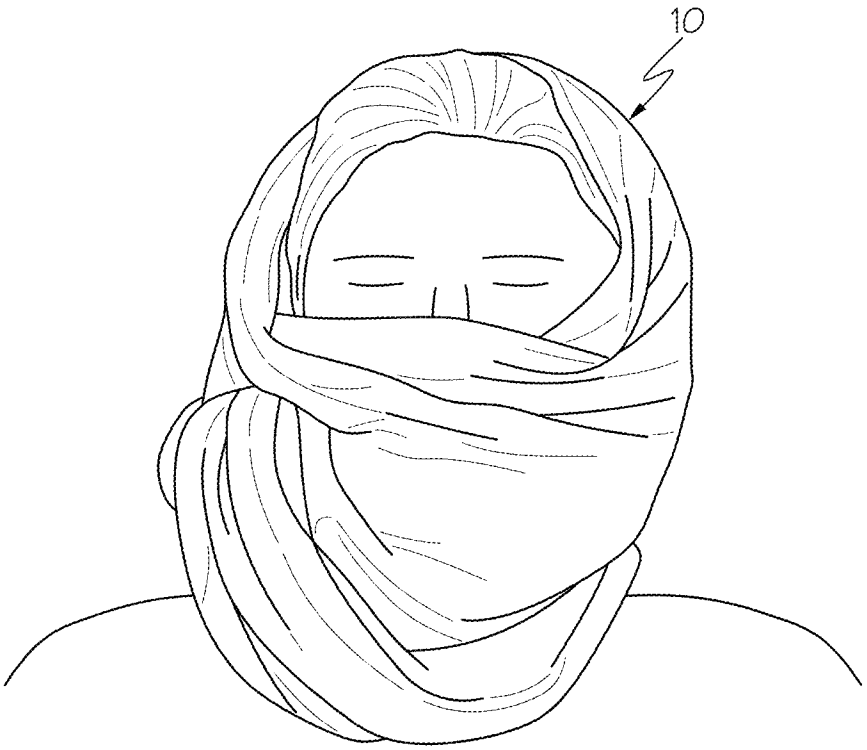
Figure 8E:
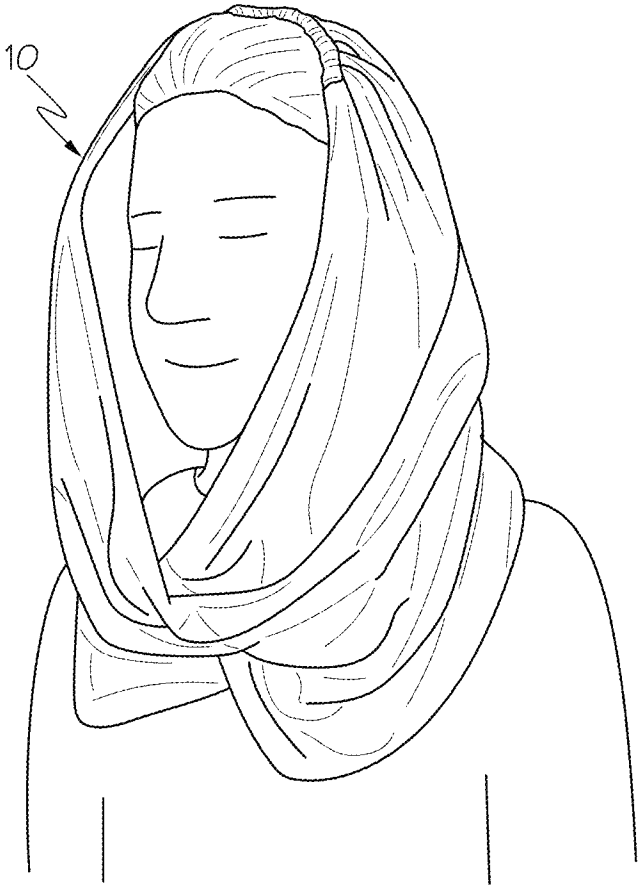

FIG. 8D shows the scarf 10 draped over the user's face, serving as an eye mask. In FIG. 8E, a fashionable double loop head cover arrangement. Still further, as seen in FIG. 8F, the scarf 10 can be double looped around the face and neck so that sections of the scarf criss-cross across the wearer's face serving as a protective mask to prevent transmission of air borne organisms or to protect one's identity.

Referring again to FIG. 1, while the size and configuration of the pouch 50 and pocket 62 may vary, in some embodiments, the pouch 50 is secured to the inside 24 of the scarf 10 only across the top edge 64. The size of the pocket 62 may be large enough to enclose the pouch 50 when turned inside out. This would position the opening of the pocket 62 behind the pouch 50 as seen in FIG. 1, which is between the back of the pouch and the inside surface 24 of the scarf 10 behind it. This may be desirable to contain more securely objects inside the pocket 62, such as a cell phone for example.

Now it will be apparent that the scarf 10 of the present invention may be worn in several styles, some for purely ornamental purposes, and some for functional purposes, such as sleeping or reading. The views shown in the drawings are illustrative and not limiting.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A scarf comprising:

a fabric cylinder having a sidewall with an inner surface and an outer surface, an open upper end having an upper edge, and an open lower end having a lower edge, wherein the cylinder has a circumference;

wherein the upper edge comprises an upper edge elastic section extending only partially around the upper edge;

wherein the lower edge comprises a lower edge elastic section spaced apart from and opposite the upper edge elastic section and extending only partially around the lower edge;

a pouch on the inner surface of the sidewall between the upper edge elastic section and the lower edge elastic section and wherein the pouch has a closure.

2. The scarf of claim 1 wherein the upper edge elastic section is about the same length as the lower edge elastic section.

3. The scarf of claim 1 further comprising an open pocket superimposed over the pouch.

4. The scarf of claim 1 wherein the fabric cylinder is a right cylinder, wherein the cylinder has a width extending between the upper and lower ends, and wherein the circumference of the cylinder is about twice the width.

5. The scarf of claim 1 wherein the pouch is lined with RFID blocking material.

6. The scarf of claim 1 wherein the pouch closure comprises one or more of the following: snaps, zipper, hooks, buttons, ties, and hook-and-loop fasteners.

7. The scarf of claim 1 further comprising connectors for securing the elastic sections adjacent to each other when the scarf is being worn.

8. The scarf of claim 7 wherein the connectors are snaps.

9. A method for securing at least one valuable, comprising:

donning the scarf of claim 1;

placing the at least one valuable in the pouch;

positioning the lower edge of the scarf over the upper edge of the scarf and tucking the lower edge under the pouch so that the pouch is double-wrapped inside the scarf.

10. The scarf of claim 1 wherein each of the upper and lower edge elastic sections comprises an elastic strip attached to the upper and lower edge, respectively, to form an upper edge expandable gathered section and a lower edge expandable gathered section.

* * * * *